United States Patent [19]

Pangburn

[11] Patent Number: 4,621,465

[45] Date of Patent: Nov. 11, 1986

[54] FLEXIBLE FILE HAVING FLEXIBLE ABRASIVE SHEETS MOUNTED ON FLEXIBLE FLANGES

[76] Inventor: William E. Pangburn, 2707 Bay Shore, Ventura, Calif. 93003

[21] Appl. No.: 734,885

[22] Filed: May 16, 1985

Related U.S. Application Data

[63] Continuation-in-part of Ser. No. 563,151, Dec. 12, 1983, Pat. No. 4,534,138.

[51] Int. Cl.[4] ..... B24D 15/04

[52] U.S. Cl. ..... 51/392; 51/363; 51/401; 132/76.4

[58] Field of Search ..... 51/205 R, 358, 363, 51/370, 371, 380, 382, 383, 386, 388, 391, 392, 394, 401; 132/76.4, 76.5

[56] References Cited

U.S. PATENT DOCUMENTS

| | | | |
|---|---|---|---|
| 893,004 | 7/1908 | Miller . | |
| 894,161 | 7/1908 | Miller . | |
| 1,562,414 | 11/1925 | McKnight | 51/391 X |
| 1,599,906 | 9/1926 | McKnight | 51/371 |
| 1,910,647 | 5/1933 | Steeg et al. . | |
| 2,091,807 | 8/1937 | Crum . | |
| 2,311,060 | 2/1943 | Lurrain . | |
| 2,430,785 | 11/1947 | Scattone | 51/392 X |
| 2,626,489 | 1/1953 | Thompson | 51/391 X |
| 2,735,434 | 2/1956 | De Rossett . | |
| 2,765,593 | 10/1956 | Salmon et al. | 51/392 X |
| 3,339,562 | 9/1967 | Rowe | 51/380 X |
| 3,596,661 | 8/1971 | Metz . | |
| 3,910,284 | 10/1975 | Orentreich . | |
| 3,975,868 | 8/1976 | Botimer | 51/370 X |
| 4,034,769 | 7/1977 | Nishimura . | |
| 4,184,499 | 1/1980 | Seidler . | |
| 4,459,987 | 7/1984 | Pangburn . | |

*Primary Examiner*—Robert P. Olszewski

*Attorney, Agent, or Firm*—William W. Haefliger

[57] ABSTRACT

In a nail file, the combination comprising (a) an elongated holder having an elongated handle, consisting of synthetic resin, said holder having relatively thin, upper and lower elongated flanges and an elongated medial web interconnecting the flanges adapting the flanges to flex relative to the web, (b) a resiliently flexible first sheet having an abrasive surface, (c) the sheet retained to one of the flanges so that said abrasive surface is outwardly presented, whereby the sheet when pressed against a fingernail flexes along with said one flange and assumes the contour of the fingernail, the sheet being elongated in the direction of the handle.

7 Claims, 4 Drawing Figures

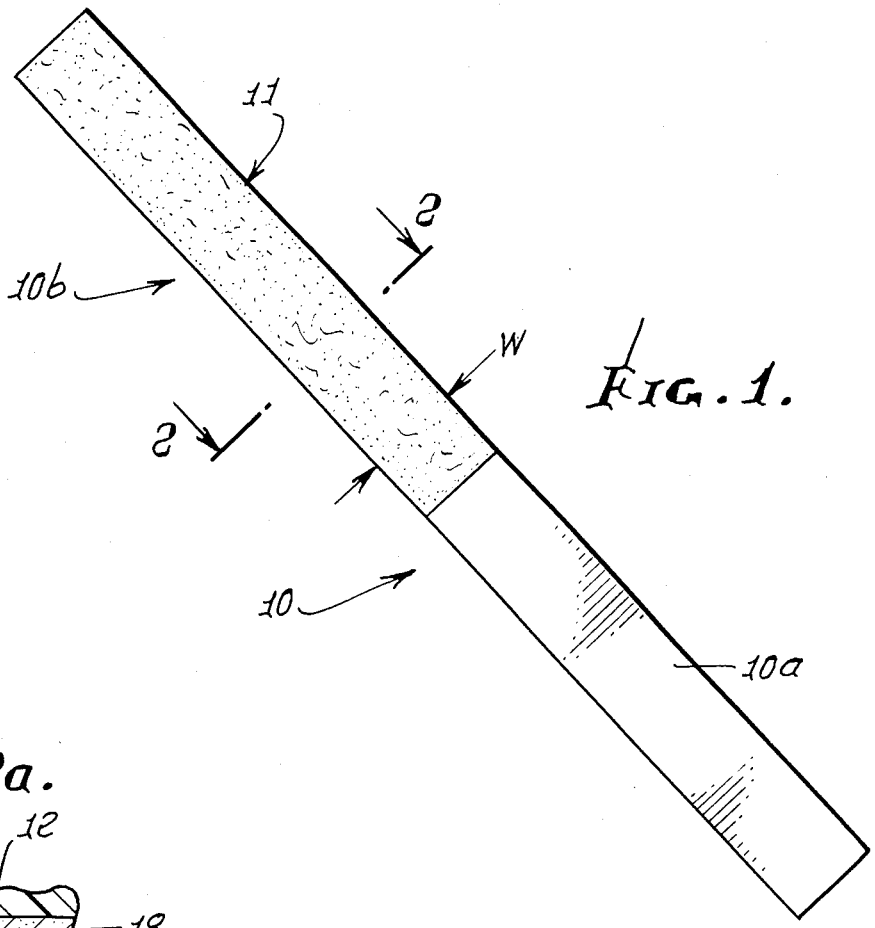
FIG. 1.
FIG. 2a.
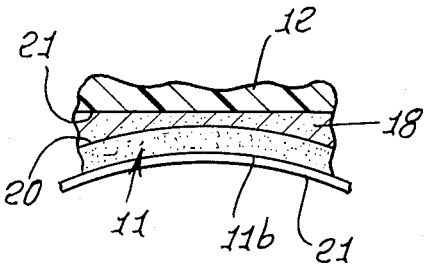
FIG. 2.
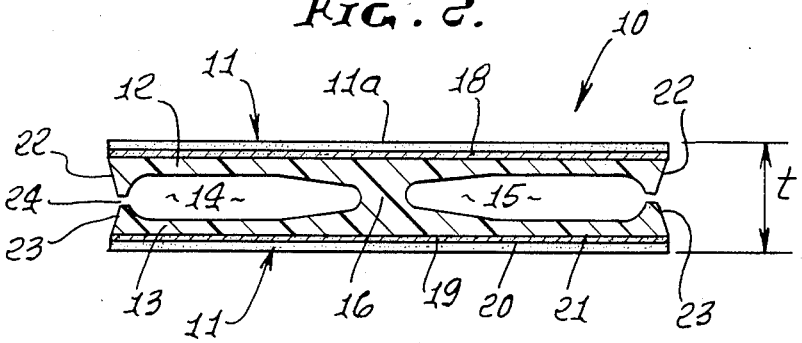
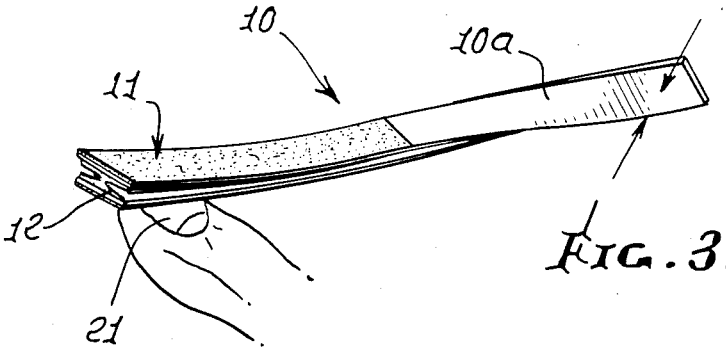
FIG. 3.

FLEXIBLE FILE HAVING FLEXIBLE ABRASIVE SHEETS MOUNTED ON FLEXIBLE FLANGES

This application is a continuation-in-part of my copending application Ser. No. 563,151, filed Dec. 12, 1983, now U.S. Pat. No. 4,534,138.

BACKGROUND OF THE INVENTION

This invention relates generally to apparatus used by manicurists to smooth and buff fingernails. More specifically it concerns a unitary device capable of convenient use to carry out either of these functions, or similar functions.

At the present time and in the past, manicurists accomplished smoothing and buffing of fingernails by using different devices which do not desirably conform to complexly curved nail surfaces; consequently they are difficult to manipulate accurately to buff and smooth such surfaces. Also, such prior devices are difficult to clean, and consequently time and effort were wasted. Further, the abrasive or prior devices tended to de-laminate, on use, the abrasive sub-strate cracking when the nail file was flexed.

SUMMARY OF THE INVENTION

It is a major object of the invention to provide apparatus overcoming the problems referred to above, and also characterized as automatically adjusting to complex nail curvatures.

Basically, the apparatus comprises:

(a) an elongated holder having an elongated handle, consisting of synthetic resin, said holder having realtively thin upper and lower elongated flanges and an elongated medial web interconnecting the flanges adapting the flanges to flex relative to the web, (b) a resiliently flexible first sheet having an abrasive surface, (c) the sheet retained to one of the flanges so that said abrasive surface is outwardly presented, whereby the sheet when pressed against a fingernail flexes along with said one flange and assumes the contour of the fingernail, the sheet being elongated in the direction of the handle.

As will appear, the holder is typically longitudinally elongated, and the flanges have projections integral with their lateral extremities, said projections adapted to interengage and transfer loading from one flange to the other during said flexing, the flanges spaced apart between the projections and said medial web. Further, a second abrasive sheet is typically adherent to the second flange, the sheet extending laterally throughout the widths of said flanges. Finally, the sheet may advantageously consist of silicone polymer carrying abrasive particulate exposed at at least one side of the sheet; and the sheets and flanges flex together, to closely conform to complex fingernail shapes, with comfort to the user, foam layers being provided to suchion the abrasive strips, as will appear. Such a holder and sheet does not result in sheet cracking or delamination, upon flexing or twisting of the holder, whereby the device is longer lasting.

These and other objects and advantages of the invention, as well as the details of an illustrative embodiment, will be more fully understood from the following specification and drawings in which:

DRAWING DESCRIPTION

FIG. 1 is a plan view of a nail file incorporating the invention;

FIG. 2 is a section on lines 2—2 of FIG. 1;

FIG. 2*a* is an enlarged fragmentary view; and

FIG. 3 is a perspective view showing use of the nail file.

DETAILED DESCRIPTION

In FIGS. 1–3, the nail file 10 includes an elongated holder, having a handle portion 10*a* well adapted to be hand held. A second portion 10*b* of the holder carries a first resiliently flexible sheet 11 having an outwardly exposed abrasive surface 11*a*. A second such sheet 11 may also be carried by the second portion of the holder, and at its opposite side, as shown.

As shown in the drawings, the holder which preferably consists of molded synthetic resin or plastic has upper and lower flanges 12 and 13 which are elongated and relatively thin. The two flanges, spaced apart for most of their widths as by the two holders 14 and 15, are interconnected by an integral medial web 16, which thereby allows the flanges to possess great flexibility, lengthwise, widthwise, and torsionwise (i.e. about the length axis of the holder). Accordingly, the sheets 11, when pressed against fingernails to be buffed or smoothed, easily assume the complex contour or curvature of the fingernail during back and forth file movement. Note that the file has overall lateral width "w" substantially greater than its overall thickness "t", these dimensions for example falling within the range:

| Dimension | Range |
|---|---|
| w | $\frac{3}{8}$ inch to $\frac{3}{4}$ inch |
| t | $\frac{1}{8}$ inch to $\frac{1}{4}$ inch |

The objective of close contour matching of the sheet 11 to the fingernail is enchanced by the provision of compressible plastic foam layers 18 and 19 located between the flanges and abrasive sheets, and adherent thereto as by suitable adhesive at their interfaces as at 20 and 21. Such thin, compressible, foam layers provide local suchioning for the portion 11*b* of the sheet forcibly engaging the nail portion 21. See FIG. 2*a*.

Each sheet and layer adherent thereto has overall thickness less than that of the flange to which the foam is adherent, as is clear from FIG. 2, for firm support of the layer and sheet allowing desired compressible cushioning; at the same time, the cantilever flange is then enabled to flex when loaded remotely from the web 16, thereby maximally conforming to a fingernail contour.

Further, desirable support of the flanges is provided by opposed elongated projections 22 and 23 integral with lateral extremities of the flanges, and adapted to interengage and transfer loading from one flexible flange to the other, during flexing under fingernail load. Note that slight gap 24 may be provided between the opposed projections of each pair, to allow initial flexing of a single flange, followed by interengagement of the projects and further but less flexing of the combined flanges—i.e., greater resistance to flexing is provided after initial flexing of one flange. This is found to yield the best, firm conformance to fingernails, during buffing, and smoothing.

Finally each adherent and abrasive sheet pair may be stripped off the flange, and replaced, when desired, a suitable liquid bonding agent or pressure sensitive adhesive being employed during replacement.

For very good results, the abrasive sheets may consist of silicone polymer carrying abrasive particulate exposed at the outer side of the sheet. The particulate may may consist of pumice, embedded in the polymer and projecting therefrom, the crevices and holes in the pumice locking to the polymer during the final cure stage.

FIG. 3 shows the holder twisted in torsion when held at 10*a*, to conform to the nail 21 being buffed.

While the use of pumice and silicone polymer supporting same has been described, the invention also contemplates the use of other suitable cosmetic abrasives, and supports or or carries therefor.

I claim:

1. In a nail file, the combination comprising (a) an elongated holder having an elongated handle, consisting of synthetic resin, said holder having relatively thin upper and lower elongated flanges, and an elongated medial web interconnecting the flanges adapting the flanges to flex relative to the web, (b) a resiliently flexible first sheet having an abrasive surface, (c) the sheet retained to one of the flanges so that said abrasive surface is outwardly presented whereby the sheet when pressed against a fingernail flexes along with said one flange and assumes the contour of the fingernail, the sheet being elongated in the direction of the handle, (d) said holder being longitudinally elongated and having lateral width greater than its thickness, the sheet extending across the width of the holder, (e) said flanges having projections integral with their lateral extremities, said projections adapted to interengage and transfer loading from one flange to the other during said flexing, the flanges spaced apart between said projections and said medial web.

2. The combination of claim 1 wherein the sheet is bonded to an outer surface defined by said one flange.

3. The combination of claim 1 including a second abrasive sheet adherent to the outer side of the other flange, and compressible plastic foam layers located between said flanges and abrasive sheets and adherent thereto, the foam layers providing cushioning for said abrasive sheets, during file use.

4. The combination of claim 3 wherein said abrasive and foam sheets and layers extend laterally throughout the widths of said flanges.

5. The combiantion of claim 3 wherein each sheet and layer adherent thereto has overall thickness less than the flange to which the foam sheet is adherent.

6. The combination of claim 3 wherein each of said abrasive sheets consists of silicone polymer carrying abrasive particulate exposed at at least one side of the sheet.

7. The combination of claim 6 wherein said particulate consists of pumice.

* * * * *